US008573924B2

(12) United States Patent
Gozdawa

(10) Patent No.: US 8,573,924 B2
(45) Date of Patent: Nov. 5, 2013

(54) GAS COMPRESSOR

(75) Inventor: Richard Julius Gozdawa, Middlesex (GB)

(73) Assignee: Yorlan Holdings Limited, Tortola (VG)

( * ) Notice: Subject to any disclaimer, the term of this patent is extended or adjusted under 35 U.S.C. 154(b) by 711 days.

(21) Appl. No.: 12/734,391

(22) PCT Filed: Oct. 29, 2008

(86) PCT No.: PCT/GB2008/003655

§ 371 (c)(1),
(2), (4) Date: Aug. 6, 2010

(87) PCT Pub. No.: WO2009/056821

PCT Pub. Date: May 7, 2009

(65) Prior Publication Data

US 2010/0296916 A1 Nov. 25, 2010

(30) Foreign Application Priority Data

Oct. 30, 2007 (GB) ..... 0721239.2

(51) Int. Cl.
*F04D 17/12* (2006.01)
*F04D 29/28* (2006.01)

(52) U.S. Cl.
USPC ..... 415/115; 416/199

(58) Field of Classification Search
USPC ..... 415/93, 98, 104; 416/199
See application file for complete search history.

(56) References Cited

U.S. PATENT DOCUMENTS

| | | | | |
|---|---|---|---|---|
| 3,717,418 | A * | 2/1973 | Pilarczyk | 415/104 |
| 6,592,654 | B2 * | 7/2003 | Brown | 95/270 |
| 8,096,782 | B2 * | 1/2012 | McCarthy | 417/366 |
| 2007/0154304 | A1 | 7/2007 | Abdallah | |

FOREIGN PATENT DOCUMENTS

| | | | |
|---|---|---|---|
| DE | 18 03 958 | | 6/1969 |
| DE | 21 15 330 | | 10/1972 |
| DE | 32 30 511 | | 2/1984 |
| FR | 1 568 781 | | 5/1969 |
| GB | 2399863 | * | 3/2003 |

OTHER PUBLICATIONS

International Search Report for PCT/GB2008/003655, mailed Apr. 17, 2009.

* cited by examiner

*Primary Examiner* — Nathaniel Wiehe
*Assistant Examiner* — Brian O Peters
(74) *Attorney, Agent, or Firm* — Kirschstein, et al.

(57) ABSTRACT

A gas compressor a rotor shaft and is arranged such that gas flow to an impeller stage is via a bore in the rotor shaft; and/or impeller stages are arranged in series such that flow into respective stages is in respectively opposed directions. The compressor most effectively functions with the rotor shaft arranged in a substantially upright orientation and beneficially has conical mounting bearing.

22 Claims, 3 Drawing Sheets

*(INBOARD TAIL BEARING)*

GAS COMPRESSOR

Figure 1:
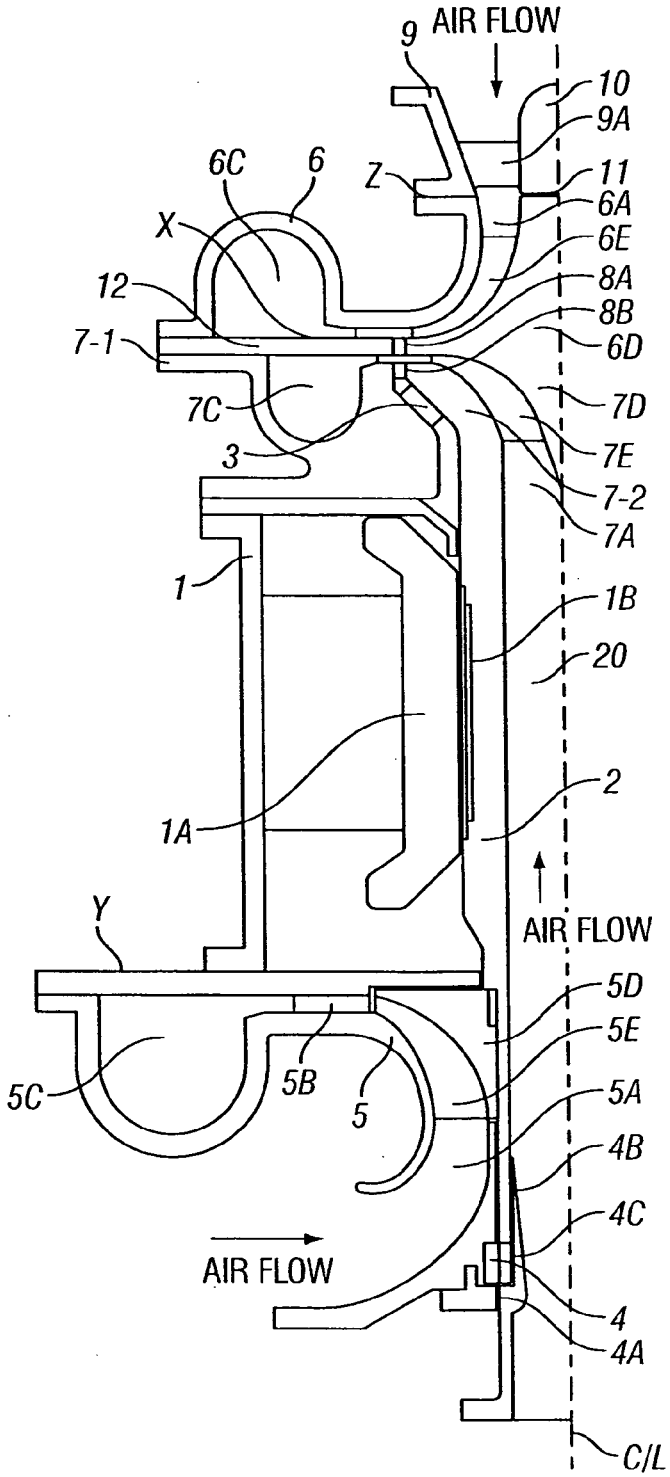

This application is the U.S. national phase of International Application No. PCT/GB2008/003655 filed 29 Oct. 2008 which designated the U.S. and claims priority to GB Patent Application No. 0721239.2 filed 30 Oct. 2007, the entire contents of each of which are hereby incorporated by reference.

The present invention relates to a gas compressor.

Gas compressors are widely used for a variety of purposes and generally comprise a rotor shaft having magnets of a motor armature mounted to the shaft. The motor shaft is mounted relative to a housing on a bearing arrangement. One or more impellers may be mounted to the driven by the motor to achieve the required gas compression.

Aspects of the present invention relates to an improved gas compressor.

According to a first aspect of the present invention, there is a gas compressor having a first and a second gas compression stage, the flow of gas into the first compression stage being in a generally opposite direction to the flow of gas into the second gas compression stage.

A significant benefit of such an arrangement is that the axial forces produced by the flow through the first and second stage largely cancel each other out, resulting in a reduced stress on the bearing arrangement. This aspect of the invention provides for the counter direction flows to balance the axial thrusts arising from two or more impellers.

The pressurised gas from the first gas compression stage is preferably directed to the gas intake for the second gas compressor.

Preferably, the rotor shaft of the gas compressor is orientated in a substantially upright position. This orientation is particular beneficial as in such a configuration forces resulting from gas flow in both directions largely cancel each other out thereby providing the significant benefit of providing a multi-stage compressor enabling increased gas pressure, and providing an upright compressor whereby the forces on the bearing arrangement are not severely increased.

The compressor is beneficially a radial flow compressor. The compressor is even more beneficially an axial inflow compressor, the gas being directed to radial outflow via a compressor impeller rotor stage carried by a rotor shaft.

The compressor even more beneficially comprises three stages, comprising a low pressure, intermediate pressure and high pressure stages. The flow of gas into the third compression stage is preferably in the same direction as the flow into the first stage. The flow into the first stage is beneficially in a substantially upright direction, and the flow in the third stage is also preferably in a substantially upright direction.

A gas intercooler is preferably provided between the first compression stage out-take and the second gas compressor intake.

Reference is made to a preferred bearing arrangement disclosed in GB2399863. The rotor shaft is preferably supported by an aero-static bearing arrangement comprising a rotary bearing element mounted for rotation with the rotor shaft and a stationary bearing element seating the rotary bearing element. The rotary and stationary bearing elements preferably have correspondingly adjacent frustroconical bearing surfaces. There is preferably further provided a gas supply to effect separation of the bearing surfaces for operation.

According to a second aspect of the present invention, there is a gas compressor comprising a rotor shaft and an impeller arrangement, the rotor shaft having a bore therein for receiving the gas such that gas flow through the bore is constrained by the walls of the bore of the rotor and the gas flow is directed to the impeller arrangement. This arrangement is particularly beneficial for a three a more stage impeller.

A significant benefit of the second aspect of the present invention is that the gas flow incident on the impeller blades is not axial but already rotational due to the rotation of the shaft, and as such the stage efficiency is improved. Additionally, cooling of the shaft is achieved through the gas flow passing through the shaft rather than around it.

In alternative definition, the invention is as defined in claim 1.

Further preferred features are set out in the appended claims.

Figure 2:
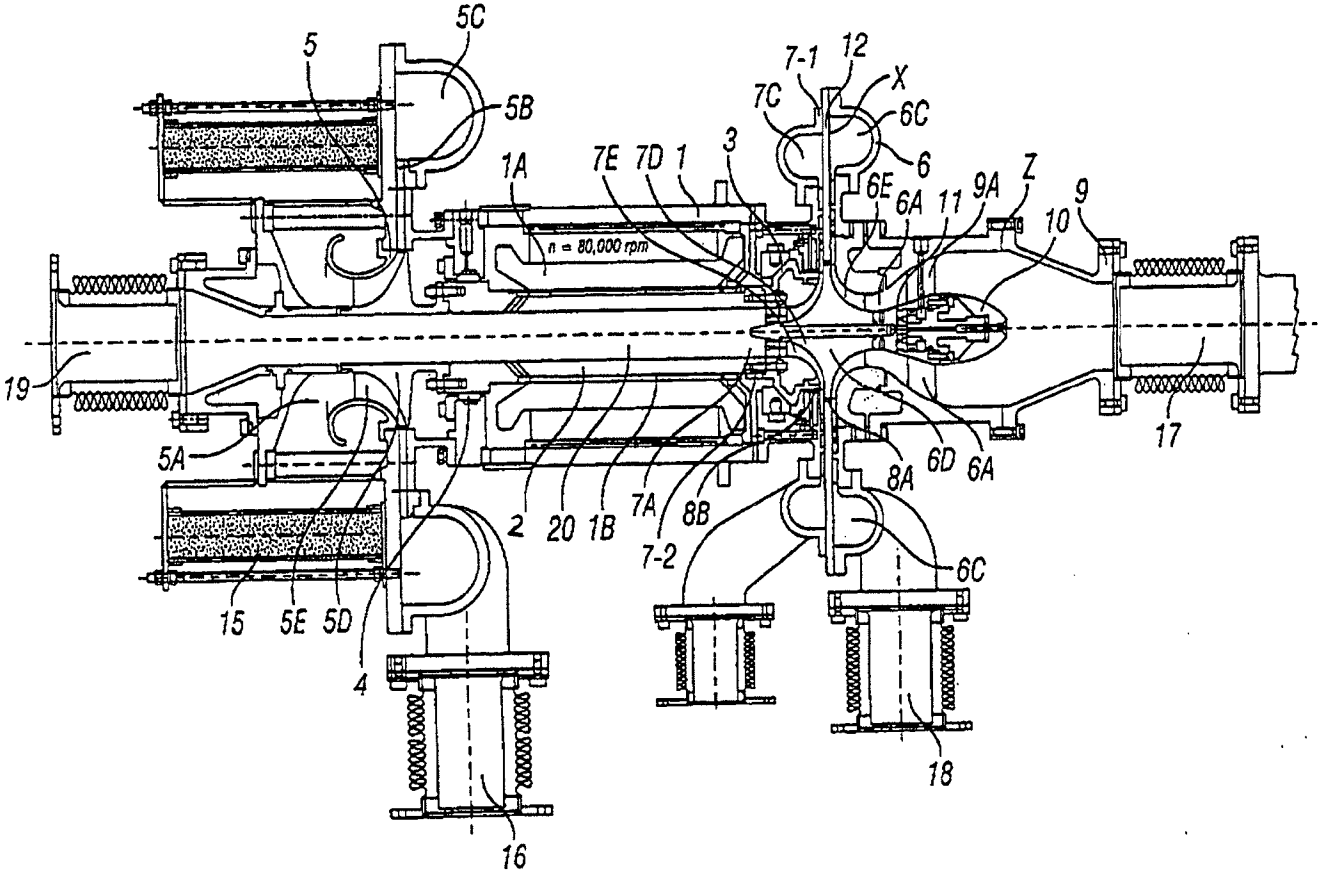
Figure 3:
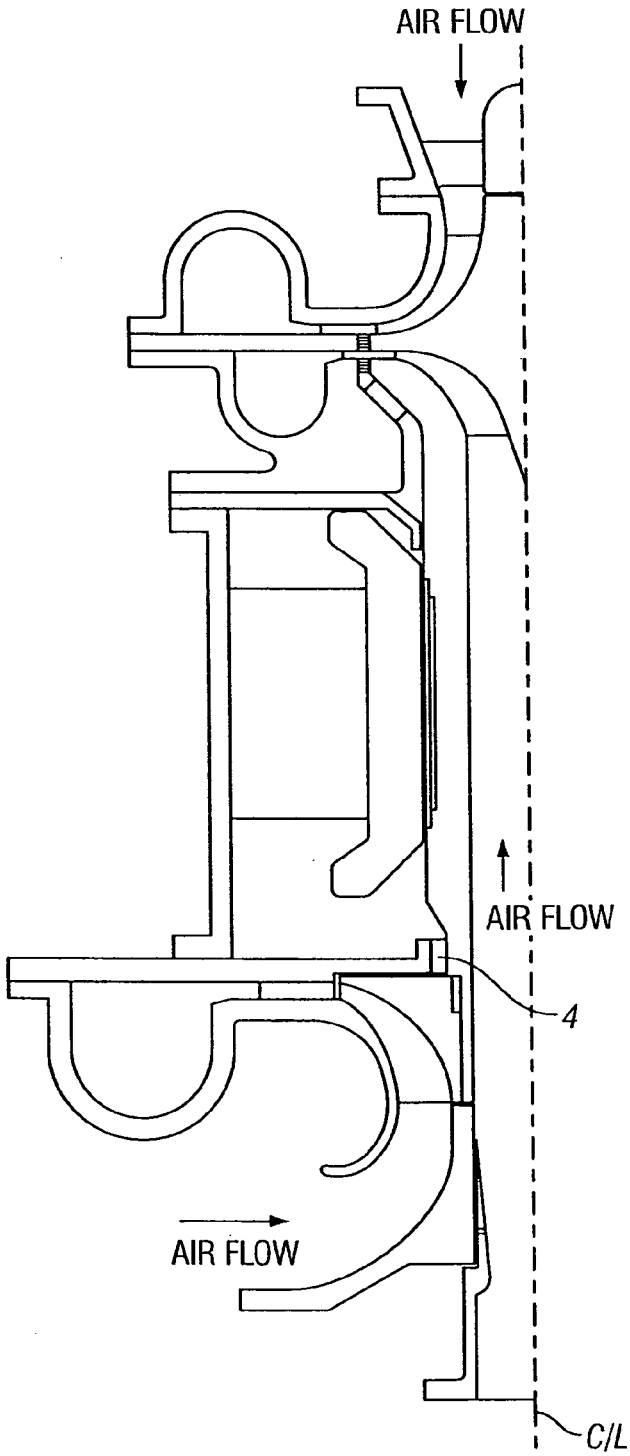

The present invention will now be described by way of example only with reference to the accompanying drawings in which:

FIG. 1 is a schematic cross sectional view of one side of a compressor according to an exemplary embodiment of the present invention FIG. 2 is a schematic cross sectional view of a compressor according to an exemplary embodiment of the present invention FIG. 3 is a cross sectional view of one side of a compressor according to an exemplary embodiment of the present invention wherein the location of tail bearing in the has been changed as compared to FIG. 1.

Referring to FIGS. 1 and 2, there is a schematic cross sectional representation of a gas compressor according to an exemplary embodiment of the present invention. Centrifugal compressors utilise an impeller in a shaped housing to force the gas to the rim of the impeller thereby increasing the velocity of the gas. It is desirable in gas compressors to achieve as high as possible gas compression ratio depending on the specific use for the compressor, and for that reason centrifugal compressors often comprise more than one stage as the compression ratio of a stage is limited by the maximum permissible peripheral speed of the blades that is in turn limited by the bursting stress of the hub. Accordingly, a number of compression stages are placed in series in which the compressed exhaust gas of a first compressor is fed into the intake of a second compressor.

The compressor of the present invention is primarily an oil free compressor arranged to operate at high speed typically at or above 40,000 rpm.

As can be seen with respect to the Figures, an exemplary embodiment of the present invention comprises a three stage compressor, i.e. a low pressure (LP) stage, and intermediate pressure (IP) stage and a high pressure (HP) stage. Although the present invention has been described with respect to a three stage compressor, it will be appreciated by a person skilled in the art that any number of compression stages could achieve advantages associated with the present invention, however for reasons outlined in more detail below, it is particularly beneficial to provide three stages.

The rotor shaft 2 has permanent magnets of a motor armature 1B mounted relative thereto. The rotor shaft 2 is hung from a conical bearing 3 and is stabilised by a tail bearing 4. Three impellers are mounted onto the shaft 2, the LP impeller comprising a hub 5D and blades/splitters 5E, the IP impeller comprising a hub 6D and blades/splitters 6E and finally the HP impeller comprising hub 7D and blades/splitters 7E. A stator 1A of the motor with its end windings is carried by an outer casing 1 that also carries the diffuser and volute of each stage. The casing also carries nose 10 that acts as an emergency restraint upon the rotor 2 carrying the respective impellers to prevent the shaft 2 rising out of its seat in the bearing 3.

Inlet gas is drawn into the compressor via an inlet filter 15 into the LP intake 5A where it is subsequently compressed by the LP impeller blades/splitters 5E. The compressed air passes through the LP diffuser 5B which may be a divergent duct section that converts the energy associated with the fast moving gas to pressure. The compressed gas then passes from volute 5C and is directed to an intercooler (not shown) via bellow 16.

The intercooled gas from the LP stage is then transferred to the IP impeller intake 6A, passing via bellow 17 to the intercooler. The IP stage comprises an inlet casing 9 and includes a plurality of supports 9A, preferably three, extending to support the nose 10. The nose 10 provides the stationary member of the surge gas thrust bearing 11 which communicates with the rotationally mounted hub 6D. The impeller hub 6D carries the blades/splitters 6E (and also the blades/splitters in the HP zone) which may be made integral with the inner surface of the shaft 2 by vacuum brazing for example. Again, the gas passes through the IP diffuser and out through the volute 6C to pass through bellow 18 and intercooler (not shown) following exit from the IP impeller stage. The IP impeller stage casing 6 includes an inlet casing portion 9 which has a flange Z separating from the rest of the casing which simplifies setting of the surge gas thrust bearing 11 to the desired cold clearance. A further flange X is provided at a partition wall 12 which enables separation of the IP casing 6 from the HP stage thereby enabling the rotor shaft 2 to be lowered into the bore of the motor to rest on bearing 3. For assembly of the rotor 2 into the machine however, the LP impeller must first be removed from the rotor 2, then once the rotor shaft 2 is in position then the LP impeller, casing 5 and IP stage casing can be replaced.

Cooled gas is then directed from the IP stage to the lowermost end of the compressor passing through bellow 19 and into an intercooler (not shown) then into an axial internal bore 20 of the rotor 2. The end of the rotor which rotates at high speed, butts against a flanged pipe is provided co-axial with the bore of the rotor that acts as the initial gas intake into the rotor bore 20. As there is relative movement between the rotor 2 and the flanged pipe, there is a leakage gap for the gas at the output pressure of the IP stage down to the pressure of the atmosphere. To increase the path and to reduce the leakage of gas a venturi insert 4C is provided which provides a relatively long leakage path 4B. It will be appreciated that providing the bearing 4 can act satisfactorily with an axial pressure gradient, it itself may become the gas seal and the vent 4A and the insert 4C are not required. However, the venturi form of the insert is selected to minimise pressure loss in the pipe to the bore.

Gas compressed by the LP and IP stages then passes through the bore of the rotor 2 and provides for effective cooling of the rotor that is heated via the bearings and eddy current losses generated by the high speed motor. Additionally, as the flow of gas passes through the bore of the rotor 2, it will acquire a significant rotation. This rotating gas flow hits the blades/splitters 7E after passing through intake 7A which act to force the gas through another diffuser and out through volute 7C. The blades of the HP impeller are arranged to receive an axial flow of gas at the inlet and the angle of the blades at inlet will be axial or substantially so. As the blades do not have to turn the flow as greatly as would be needed in absence of rotation of the incident flow, the stage efficiency is improved. The design of the rotor and HP impeller is significant in that the gas flow through the HP impeller is guided between an outer rotating surface (the casing shroud 7-2 of the HP stage which forms part of the rotor 2 and rotates in unison with the impeller blades 7E and impeller hub 7D) and an inner rotating surface. The shroud of the HP impeller forms part of the rotor and rotates in unison with the rotor and impeller. This is contrasted with standard designs in which the outer shroud of a stage is typically stationary with respect to the rotary impeller.

The rotating shaft or shroud area 7-2 carries the rotating track of the conical bearing 3. A labyrinth gland 8A is provided to control leakage from the HP diffuser to the IP stage as at this point rotation of the rotor 2 meets a non-rotating casing. Also provided for this purpose is a second labyrinth gland 8B that controls leakage from the diffuser of the HP stage to the motor casing.

Referring to FIG. 3, it will be appreciated that the tail bearing 4 can be relocated as indicated. Due to the configuration of the bearing 3, the bearing 4 is a journal bearing required to withstand minimal load only.

A significant advantage of the present compressor is that it optimally functions in a substantially upright configuration. This is achieved through the provision of a conical bearing arrangement 3 that acts as a primary thrust bearing, journal bearing and seal for the compressor, wherein the rotor shaft 2 is hung from the conical bearing 3 and is stabilised by tail bearing 4 (whether configured as in FIG. 1 or 3). Cooled gas at an elevated pressure from the outlet of one of the compressor stages is drawn and directed to the bearing surface of the stationary bearing element which is provided with gas supply ports or orifices to supply separating gas at pressure to the interface between the bearing surfaces of the bearing. It is preferred that three or more gas supply ports or orifices are provided, equally spaced about the periphery of the bearing. Beneficially, the compressor is provided with an operation control system ensuring that compressor start-up is only effected when sufficient gas separation exists at the bearing surface interface. Oil lubrication is therefore not required making the compressor oil-free running.

The bearing 3 is beneficially a conical aero-static bearing that requires a minimum pressure to be supplied for the bearing surfaces to be separated. The starting and stopping of the compressor is therefore safeguarded in this respect when the receiver has sufficient pressure, however an auxiliary supply of pressure is required to cause separation. A preferred bearing arrangement is disclosed in GB2399863.

Forces acting in a generally downward direction on the shaft 2 in a single vertical impeller are the force arising from the static pressure over the upper face of the impeller, the force produced by the rate of change in momentum of the flow as it changes in direction through the impeller from axial at inlet to radial at exhaust, the weight of the rotor assembly and the static pressure, slightly sub-atmospheric. It will be appreciated that if all of these forces act on each impeller in a generally downward direction, then the force needed in the bearings to overcome this force is significant. For this reason, and with reference to the drawings, the direction of the gas flow for the LP and HP stages is in a generally upward direction. Therefore, the axial forces of two stages of the compressor largely cancel and thus the axial force of the third stage relieves the load on the conical bearings. Such an embodiment therefore provides a significant advantage of being able to a significantly greater overall compression ratio, whilst configuring the stages such that axial forces from two stages largely cancel each other out.

It will be appreciated that configuration of the compressor can be changed such that the LP stage and IP stage can be swapped around such that the LP stage is at the top. However, this is an inferior operating system.

The present invention has been described by way of example only and it will be appreciated by a person skilled in the art that variations and modifications may be made without departing from the scope of protection afforded by the appended claims. It should also be noted that both aspects of the present invention as defined in the appended claims may be incorporated into a preferred embodiment showing both aspects.

The invention claimed is:

1. A gas compressor comprising a rotor shaft carrying a plurality of impeller stages, wherein:

the impeller stages are arranged in series in order of increasing pressure, gas flow into the respective stages being in respectively opposed directions;

the gas flow to the highest pressure impeller stage is via a bore in the rotor shaft; and the bore in the rotor shaft passes through the lowest pressure impeller stage.

2. A gas compressor according to claim 1, wherein the bore in the rotor shaft is substantially hollow and has one of a longitudinally extending bore and an axially extending bore.

3. A gas compressor according to claim 1, wherein the impeller stage to which gas is directed through the bore of the rotor shaft has an impeller shroud that is spaced from an impeller hub to define a flow passage through the impeller, the impeller shroud rotating in unison with the impeller and the rotor shaft.

4. A gas compressor according to claim 1, wherein the gas flow into the bore of the rotor shaft is from an upstream lower pressure impeller stage.

5. A gas compressor according to claim 1, wherein the gas flow into the bore of the rotor shaft is via an end of the rotor shaft.

6. A gas compressor according to claim 1, wherein the gas flow into the bore of the rotor shaft is via an intercooler.

7. A gas compressor according to claim 1, wherein the rotor shaft is orientated in an upright position.

8. A gas compressor according to claim 1, wherein the impeller stage into which the airflow is directed via the rotor shaft bore is an axial inflow/radial outflow impeller stage.

9. A gas compressor according to claim 1, wherein a primary bearing arrangement is provided for supporting the rotor shaft, the bearing arrangement having a rotary bearing element mounted for rotation with the rotor shaft and a stationary bearing element cooperating with the rotary bearing element for supporting the rotor shaft.

10. A gas compressor according to claim 9, wherein the rotary and stationary elements have correspondingly adjacent substantially frustoconical elements.

11. A gas compressor according to claim 9, wherein the bearing arrangement acts to take up both shaft axial (thrust) and shaft radial (journal) forces.

12. A gas compressor according to claim 9, wherein the rotor shaft is orientated in an upright position, and wherein the bearing arrangement is provided proximate an upper portion of the rotor shaft.

13. A gas compressor according to claim 9, wherein the rotary bearing element sits in a seat defined by the stationary bearing element.

14. A gas compressor according to claim 1, wherein the rotor shaft is orientated in an upright position, and wherein a lower portion of the rotor shaft is provided with a bearing arrangement for taking up journal load.

15. A gas compressor according to claim 1, wherein the rotor shaft is orientated in an upright position, and wherein the rotor shaft carries a compressor impeller at an upper end of the rotor shaft to which gas is directed axially via an interior of the rotor shaft, a bearing element being mounted to the rotor shaft below the impeller, the rotor shaft bearing element being seated in a seat formed by a bearing surface of a stationary bearing element.

16. A gas compressor according to claim 1, wherein the rotor shaft is electrically driven.

17. A gas compressor according to claim 1, including an electric motor arrangement to drive the rotor shaft, the electric motor arrangement comprising an armature mounted on the rotor shaft and a stator carried by a compressor housing surrounding the armature.

18. A gas compressor according to claim 1, wherein a plurality of compressor stages are provided in series mounted to the rotor shaft; and wherein one or more gas intercoolers are provided between the impeller stages.

19. A gas compressor according to claim 1, wherein the rotor shaft is orientated in an upright position, and wherein the gas flow to the impeller stages via the rotor shaft is in a generally upward direction.

20. A gas compressor according to claim 1, wherein the highest pressure impeller stage, the lowest pressure impeller stage and an intermediate pressure impeller stage are all mounted in series to the rotor shaft.

21. A gas compressor according to claim 20, wherein an axial force acting on the high highest pressure and lowest pressure stages is in a first axial direction, and wherein an axial force acting on the intermediate pressure stage is in an opposed axial direction of the rotor shaft.

22. A gas compressor according to claim 20, wherein each of the impeller stages comprises an axial inflow/radial outflow impeller.

* * * * *